US008156756B2

(12) United States Patent
Kamakura et al.

(10) Patent No.: US 8,156,756 B2
(45) Date of Patent: Apr. 17, 2012

(54) FLUID MACHINE

(75) Inventors: Eiji Kamakura, Sakai (JP); Katsumi Sakitani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 599 days.

(21) Appl. No.: 12/515,055

(22) PCT Filed: Nov. 21, 2007

(86) PCT No.: PCT/JP2007/072573

§ 371 (c)(1),
(2), (4) Date: May 15, 2009

(87) PCT Pub. No.: WO2008/062837

PCT Pub. Date: May 29, 2008

(65) Prior Publication Data

US 2010/0074769 A1 Mar. 25, 2010

(30) Foreign Application Priority Data

Nov. 24, 2006 (JP) ..... 2006-317116

(51) Int. Cl.
*F25D 9/00* (2006.01)
*F04B 39/06* (2006.01)
*F01C 11/00* (2006.01)

(52) U.S. Cl. ..... 62/402; 417/373; 418/210

(58) Field of Classification Search ..... 62/402; 417/406, 373; 418/60, 210
See application file for complete search history.

(56) References Cited

U.S. PATENT DOCUMENTS

2007/0053782 A1 3/2007 Okamoto et al.

FOREIGN PATENT DOCUMENTS

JP 2005-106046 4/2005
JP 2005-106064 4/2005

*Primary Examiner* — Chen Wen Jiang
(74) *Attorney, Agent, or Firm* — Global IP Counselors

(57) ABSTRACT

A fluid machine includes a casing, a compression mechanism for compressing refrigerant, an expansion mechanism for expanding refrigerant, and a rotary shaft connecting the compression mechanism and the expansion mechanism. The compression mechanism, the expansion mechanism and the rotary shaft are disposed in the casing. A heat insulator partitions an internal space of the casing into a first space with the expansion mechanism disposed therein and a second space with the compression mechanism disposed therein. The rotary shaft passes through the heat insulator. An elastically deformable seal element seals a clearance between an outer periphery of the heat insulator and an inner periphery of the casing.

10 Claims, 8 Drawing Sheets

FLUID MACHINE

CROSS-REFERENCE TO RELATED APPLICATIONS

This U.S. National stage application claims priority under 35 U.S.C. §119(a) to Japanese Patent Application No. 2006-317116, filed in Japan on Nov. 24, 2006, the entire contents of which are hereby incorporated herein by reference.

TECHNICAL FIELD

This invention relates to fluid machines in which a compression mechanism and an expansion mechanism are contained in a single casing.

BACKGROUND ART

Fluid machines are conventionally known in which an expansion mechanism, an electric motor and a compression mechanism are connected by a single rotary shaft. In such a fluid machine, the expansion mechanism generates power by expanding fluid introduced thereinto. The power generated by the expansion mechanism, together with power generated by the electric motor, is transmitted to the compression mechanism by the rotary shaft. Then, the compression mechanism is driven by the power transmitted from the expansion mechanism and the electric motor to suck the fluid and compress it.

In such a fluid machine, the expansion mechanism is heated by high-temperature fluid discharged from the compressor. Thus, when used for hot water supply, the fluid machine causes a decrease in the discharge gas temperature of the compressor, which decreases the hot water supply temperature. On the other hand, when used for air conditioning, the fluid machine causes a decrease in supply air temperature during heating operation and degrades the performance during cooling operation. Furthermore, the expansion mechanism itself causes an internal heat loss, whereby its power recovery effect is set off.

To prevent these problems of performance degradation and decrease in power recovery effect, Published Japanese Patent Application No. 2005-106064, for example, discloses a technique in which a heat insulator is attached to the expansion mechanism.

DISCLOSURE OF THE INVENTION

Problems to be Solved by the Invention

However, because in the technique of Published Japanese Patent Application No. 2005-106064 the heat insulator is provided to abut on the front head, consideration must be given to ease of assembly and prevention of thermal expansion damage to the heat insulator due to a difference in coefficient of linear expansion between the casing and the heat insulator. Therefore, a certain clearance is required between the inner periphery of the casing and each of the outer peripheries of the heat insulator and the front head.

In the casing, a first space around the expansion mechanism has a low temperature and a high density, while a second space around the compression mechanism has a high temperature and a low density. Therefore, if the above clearance is formed, refrigerant around the expansion mechanism and refrigerant around the compression mechanism may flow through the clearance. For example, when carbon dioxide is used as the refrigerant under heating conditions for air conditioning and the compression mechanism has a discharge pressure of 9 MPA and a discharge temperature of 85° C., the surface temperature of the expansion mechanism often reaches approximately 20° C. In this case, the second space around the compression mechanism and the first space around the expansion mechanism have their respective refrigerant densities of approximately 180 and 840 kg/m$^3$, wherein the density ratio between both the spaces is higher than 1:4.

As a result, even if such a heat insulator is provided, refrigerant may convect between the first space around the expansion mechanism and the second space around the compression mechanism. Thus, the refrigerant discharged from the compression mechanism may be cooled by the refrigerant coming from the expansion mechanism, while the refrigerant flowing through the expansion mechanism may be heated through thermal conduction of the expansion mechanism by the refrigerant coming from the compression mechanism. Therefore, there still exist the above problems of decrease in hot water supply temperature in use for hot water supply, decrease in supply air temperature during heating in use for air conditioning, deficiency in performance during cooling in use for air conditioning and offset of power recovery effect of the expansion mechanism.

The present invention has been made in view of the foregoing points and, therefore, an object of the invention is that a fluid machine in which a compression mechanism and an expansion mechanism are contained in a single casing prevents refrigerant convection between the first space around the expansion mechanism and the second space around the compression mechanism to prevent heat exchange due to mass transfer and thereby prevent performance degradation and decrease in power recovery effect, while taking into consideration ease of assembly and prevention of thermal expansion damage to the heat insulator.

Means to Solve the Problems

To attain the above object, in the present invention, a seal element or means is used to seal the clearance between the outer periphery of the heat insulator (90) and the inner periphery of the casing (31).

Specifically, a first aspect of the invention is directed to a fluid machine disposed in a refrigerant circuit (20) operating in a refrigeration cycle by circulating refrigerant therethrough.

The fluid machine includes: a casing (31); a compression mechanism (50) contained in the casing (31) and configured to compress the refrigerant; an expansion mechanism (60) contained in the casing (31) and configured to expand the refrigerant; a rotary shaft (40) disposed in the casing (31) and connecting the compression mechanism (50) and the expansion mechanism (60); a heat insulator (90) disposed in the internal space of the casing (31) and passed through by the rotary shaft (40), the heat insulator (90) partitioning the internal space of the casing (31) into a first space (48) in which the expansion mechanism (60) is placed and a second space (49) in which the compression mechanism (50) is placed; and an elastically deformable seal element or means (92, 94) sealing a clearance between the outer periphery of the heat insulator (90) and the inner periphery of the casing (31).

With the above structure, the refrigerant compressed by the compression mechanism (50) of the fluid machine (30), which is disposed in the refrigerant circuit (20), releases heat in a heat exchanger for heat release and then flows into the expansion mechanism (60) of the fluid machine (30). In the expansion mechanism (60), high-pressure refrigerant having flowed thereinto expands. Power recovered from the high-pressure refrigerant in the expansion mechanism (60) is transmitted to the compression mechanism (50) by the rotary shaft (40) and used to drive the compression mechanism (50). The refrigerant having expanded in the expansion mechanism (60) takes heat in a heat exchanger for heat absorption and is then sucked into the compression mechanism (50) of the fluid machine (30).

Since the heat insulator (90) partitions the internal space of the casing (31) into the first space (48) in which the expansion mechanism (60) is placed and the second space (49) in which the compression mechanism (50) is placed, the first space (48) is kept at low temperature and high density and the second space (49) is kept at high temperature and low density. Meanwhile, considering ease of assembly and prevention of thermal expansion damage to the heat insulator (90) due to a difference in coefficient of linear expansion between the casing (31) and the heat insulator (90), a certain clearance is required between the outer periphery of the heat insulator (90) and the inner periphery of the casing (31). Even if such a clearance is formed, the elastically deformable seal means seals the clearance to prevent refrigerant around the expansion mechanism (60) and refrigerant around the compression mechanism (50) from flowing through the clearance. This prevents occurrence of heat exchange due to mass transfer and thereby prevents performance degradation and decrease in power recovery effect.

A second aspect of the invention is the fluid machine according to the first aspect of the invention, wherein the fluid machine is configured so that the refrigerant is introduced from the refrigerant circuit (20) directly into the compression mechanism (50) and the compressed refrigerant is discharged from the compression mechanism (50) to the second space (49) and then flows out of the second space (49) to the outside of the casing (31), and the heat insulator (90) abuts on the side of the expansion mechanism (60) near to the compression mechanism (50).

With the above configuration, the interior of the casing (31) is kept under high-temperature and high-pressure conditions, thereby providing a so-called high-pressure dome fluid machine. In this case, the heat insulator (90) separates the first space (48) from the second space (49) to abut on the low-temperature expansion mechanism (60) significantly different in temperature from the atmosphere in the rest of the interior of the casing (31). This effectively prevents occurrence of refrigerant convection to prevent heat exchange due to mass transfer and thereby prevent performance degradation and decrease in power recovery effect.

A third aspect of the invention is the fluid machine according to the first aspect of the invention, wherein the fluid machine is configured so that the refrigerant is introduced from the refrigerant circuit (20) directly into the compression mechanism (50) and the compressed refrigerant is discharged directly to the outside of the casing (31), and the heat insulator (90) abuts on the side of the compression mechanism (50) near to the expansion mechanism (60).

With the above configuration, the interior of the casing (31) is kept under low-temperature and low-pressure conditions, thereby providing a so-called low-pressure dome fluid machine. Thus, the expansion mechanism (60) is prevented from being heated by high-temperature discharged refrigerant, while the high-temperature discharged refrigerant is prevented from being cooled by the expansion mechanism (60). Furthermore, the heat insulator (90) separates the first space (48) from the second space (49) to abut on the high-temperature compression mechanism (50) significantly different in temperature from the atmosphere in the rest of the interior of the casing (31). This effectively prevents occurrence of refrigerant convection to prevent heat exchange due to mass transfer thereby prevent performance degradation and decrease in power recovery effect.

A fourth aspect of the invention is the fluid machine according to any one of the first to third aspects of the invention, wherein the seal means is an O-ring (92) fitted around the outer periphery of the heat insulator (90).

With the above structure, since in assembly the elastically deformable O-ring (92) is compressed to deform, the heat insulator (90) can be easily inserted into the casing (31). Furthermore, even if the heat insulator (90) thermally expands, the O-ring (92) is merely compressed and the heat insulator (90) is not damaged. On the other hand, even if the heat insulator (90) thermally contracts, the O-ring (92) put into a compressed state is merely restored and a seal is maintained between the outer periphery of the heat insulator (90) and the inner periphery of the casing (31). Thus, the refrigerant is prevented from convecting, which prevents occurrence of heat exchange due to mass transfer and thereby prevents performance degradation and decrease in power recovery effect.

A fifth aspect of the invention is the fluid machine according to any one of the first to third aspects of the invention, wherein the seal means is a flange (94) integrally formed on the outer periphery of the heat insulator (90).

With the above structure, since in assembly the elastically deformable flange (94) is compressed to deform, the heat insulator (90) can be easily inserted into the casing (31). Furthermore, even if the heat insulator (90) thermally expands, the flange (94) is merely compressed and the heat insulator (90) is not damaged. On the other hand, even if the heat insulator (90) thermally contracts, the flange (94) put into a compressed state is merely restored and a seal is maintained between the outer periphery of the heat insulator (90) and the inner periphery of the casing (31). Thus, the refrigerant is prevented from convecting, which prevents occurrence of heat exchange due to mass transfer and thereby prevents performance degradation and decrease in power recovery effect.

A sixth aspect of the invention is the fluid machine according to any one of the first to fifth aspects of the invention, wherein a communicating channel (93) is formed that communicates the first space (48) with the second space (49) to reduce the pressure difference between the first space (48) and the second space (49).

With the above structure, since high-pressure refrigerant flows through the communicating channel (93) into the low-pressure space, the pressure difference between the first space (48) and the second space (49) is reduced. This prevents damage to the heat insulator (90) due to a significant increase in pressure difference between both the spaces. For example, if a single narrow communicating channel (93) is formed, the refrigerant is prevented from convecting.

A seventh aspect of the invention is the fluid machine according to the sixth aspect of the invention, wherein the communicating channel (93) is formed in the heat insulator (90).

With the above structure, simply by forming a communicating channel (93) in the heat insulator (90), the heat insulator (90) can be prevented from being damaged by a significant increase in pressure difference between the first space (48) and the second space (49).

An eighth aspect of the invention is the fluid machine according to the sixth aspect of the invention, wherein the communicating channel (93) is formed by a capillary tube mounted to the outer periphery of the casing (31) to stride over the heat insulator (90) and communicate the first space (48) with the second space (49).

With the above structure, since high-pressure refrigerant flows through the capillary tube into the low-pressure space, this prevents damage to the heat insulator (90) due to a significant increase in pressure difference between the first space (48) and the second space (49) while preventing the refrigerant from convecting.

A ninth aspect of the invention is the fluid machine according to any one of the first to eighth aspects of the invention, wherein the refrigerant circuit (20) uses carbon dioxide as the refrigerant to operate in a supercritical refrigeration cycle.

With the above configuration, carbon dioxide as the refrigerant circulates through the refrigerant circuit (20) in which the fluid machine (30) is connected. The compression mechanism (50) of the fluid machine (30) compresses sucked refrigerant to the critical pressure or higher and then discharges it. The high-pressure refrigerant of critical pressure or higher is introduced into the expansion mechanism (60) of the fluid machine (30) and expands therein.

A tenth aspect of the invention is the fluid machine according to any one of the first to ninth aspects of the invention, wherein the expansion mechanism (60) is constituted by a rotary expander including: a cylinder (71, 81) closed at both ends; a piston (75, 85) engaged with the rotary shaft (40) and contained in the cylinder (71, 81) to form an expansion chamber (72, 82); and a blade (76, 86) for partitioning the expansion chamber (72, 82) into a high-pressure chamber and a low-pressure chamber.

With the above structure, when the refrigerant introduced into the expansion chamber (72, 82) expands, the piston (75, 85) moves to drive the rotary shaft (40). Then, the compression mechanism (50) is driven by the power transmitted from the expansion mechanism (60) and the electric motor to suck the refrigerant and compress it.

Effects of the Invention

As described above, in the first aspect of the invention, a clearance is formed between the outer periphery of the heat insulator (90) and the inner periphery of the casing (31) to take into consideration ease of assembly and prevention of thermal expansion damage to the heat insulator (90), and the clearance is sealed by the elastically deformable seal element (means). This prevents the refrigerant from convecting between the first space (48) around the expansion mechanism (60) and the second space (49) around the compression mechanism (50) to prevent heat exchange due to mass transfer and thereby prevent performance degradation and decrease in power recovery effect.

According to the second aspect of the invention, since the first space (48) and the second space (49) are separated from each other by the heat insulator (90) in the close vicinity of the expansion mechanism (60) significantly different in temperature from the atmosphere in the rest of the interior of the casing (31), this effectively prevents occurrence of refrigerant convection to prevent heat exchange due to mass transfer and thereby prevent performance degradation and decrease in power recovery effect.

According to the third aspect of the invention, since the first space (48) and the second space (49) are separated from each other by the heat insulator (90) in the close vicinity of the compression mechanism (50) significantly different in temperature from the atmosphere in the rest of the interior of the casing (31), this effectively prevents occurrence of refrigerant convection to prevent heat exchange due to mass transfer and thereby prevent performance degradation and decrease in power recovery effect.

According to the fourth aspect of the invention, since the clearance between the heat insulator (90) and the inner periphery of the casing (31) is sealed by the O-ring (92), this provides a fluid machine easy to assemble and causing neither performance degradation nor decrease in power recovery effect.

According to the fifth aspect of the invention, since the clearance between the heat insulator (90) and the inner periphery of the casing (31) is sealed by the flange (94) formed integrally on the outer periphery of the heat insulator (90), this provides a fluid machine easy to assemble and causing neither performance degradation nor decrease in power recovery effect.

According to the sixth aspect of the invention, since the communicating channel (93) is formed to reduce the pressure difference between the first space (48) and the second space (49), this effectively prevents damage to the heat insulator (90).

According to the seventh aspect of the invention, since the communicating channel (93) is formed in the heat insulator (90) to reduce the pressure difference between the first space (48) and the second space (49), this prevents damage to the heat insulator (90) and thereby increases the durability of the heat insulator (90).

According to the eighth aspect of the invention, since a capillary tube is mounted to the outer periphery of the casing (31) to stride over the heat insulator (90) and thereby reduces the pressure difference between the first space (48) and the second space (49), this prevents damage to the heat insulator (90) and thereby increases the durability of the heat insulator (90).

DETAILED DESCRIPTION OF THE INVENTION

Embodiments of the present invention will be described below in detail with reference to the drawings. This embodiment is directed to an air conditioner including a compression/expansion unit that is a fluid machine according to the present invention.

<General Structure of Air Conditioner>

Figure 1:
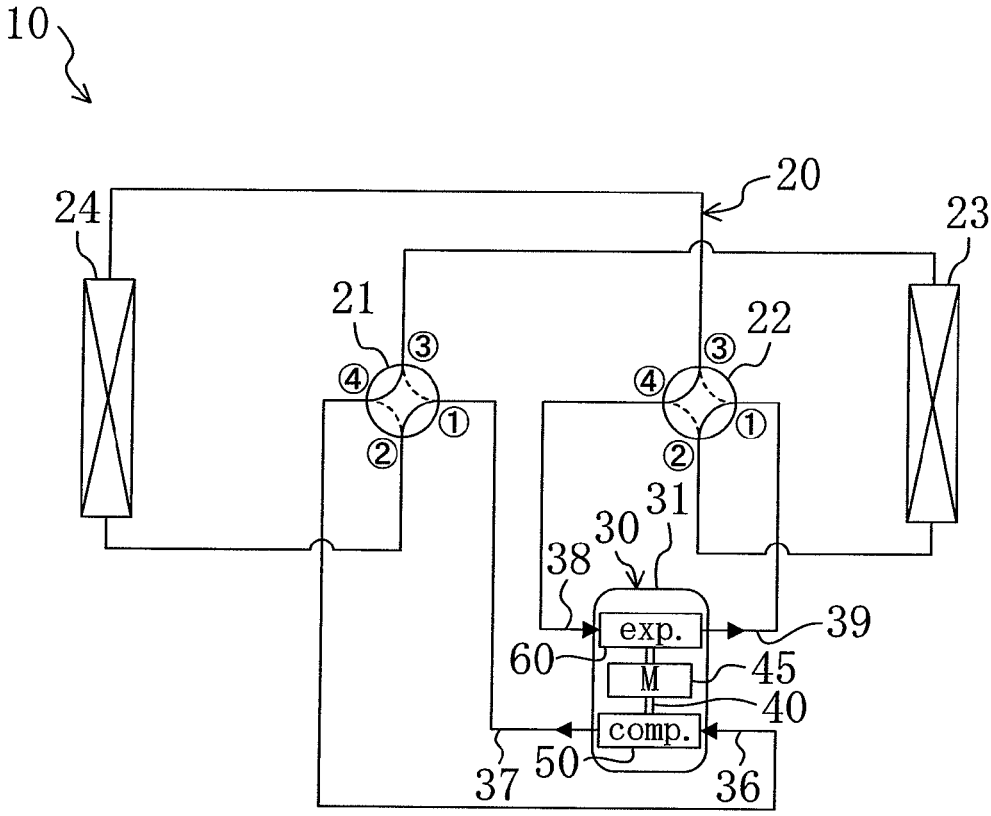
FIG. 1 is a piping diagram showing the configuration of a refrigerant circuit in Embodiment 1.

As shown in FIG. 1, the air conditioner (1) according to this embodiment includes a refrigerant circuit (20). Connected in the refrigerant circuit (20) are the compression/expansion unit (30), an outdoor heat exchanger (23), an indoor heat exchanger (24), a first four-way selector valve (21) and a second four-way selector valve (22). Furthermore, the refrigerant circuit (20) is filled with carbon dioxide ($CO_2$) as refrigerant.

The compression/expansion unit (30) includes a casing (31) formed in the shape of a vertically long, cylindrical, closed container. The casing (31) contains a compression mechanism (50), an expansion mechanism (60) and an electric motor (45). Inside the casing (31), the compression mechanism (50), the electric motor (45) and the expansion mechanism (60) are arranged in bottom to top order. The details of the compression/expansion unit (30) will be described later.

In the refrigerant circuit (20), the compression mechanism (50) is connected at its discharge side (a discharge pipe (37)) to the first port of the first four-way selector valve (21) and connected at its suction side (suction pipes (36)) to the fourth port of the first four-way selector valve (21). On the other hand, the expansion mechanism (60) is connected at its outflow side (an outlet pipe (39)) to the first port of the second four-way selector valve (22) and connected at its inflow side (an inlet pipe (38)) to the fourth port of the second four-way selector valve (22).

Furthermore, in the refrigerant circuit (20), the outdoor heat exchanger (23) is connected at one end to the second port of the second four-way selector valve (22) and connected at the other end to the third port of the first four-way selector valve (21). On the other hand, the indoor heat exchanger (24) is connected at one end to the second port of the first four-way selector valve (21) and connected at the other end to the third port of the second four-way selector valve (22).

The first four-way selector valve (21) and the second four-way selector valve (22) are each configured to be switchable between a position in which the first and second ports are communicated with each other and the third and fourth ports are communicated with each other (the position shown in the solid lines in FIG. 1) and a position in which the first and third ports are communicated with each other and the second and fourth ports are communicated with each other (the position shown in the broken lines in FIG. 1).

<Structure of Compression/Expansion Unit>

Figure 2:
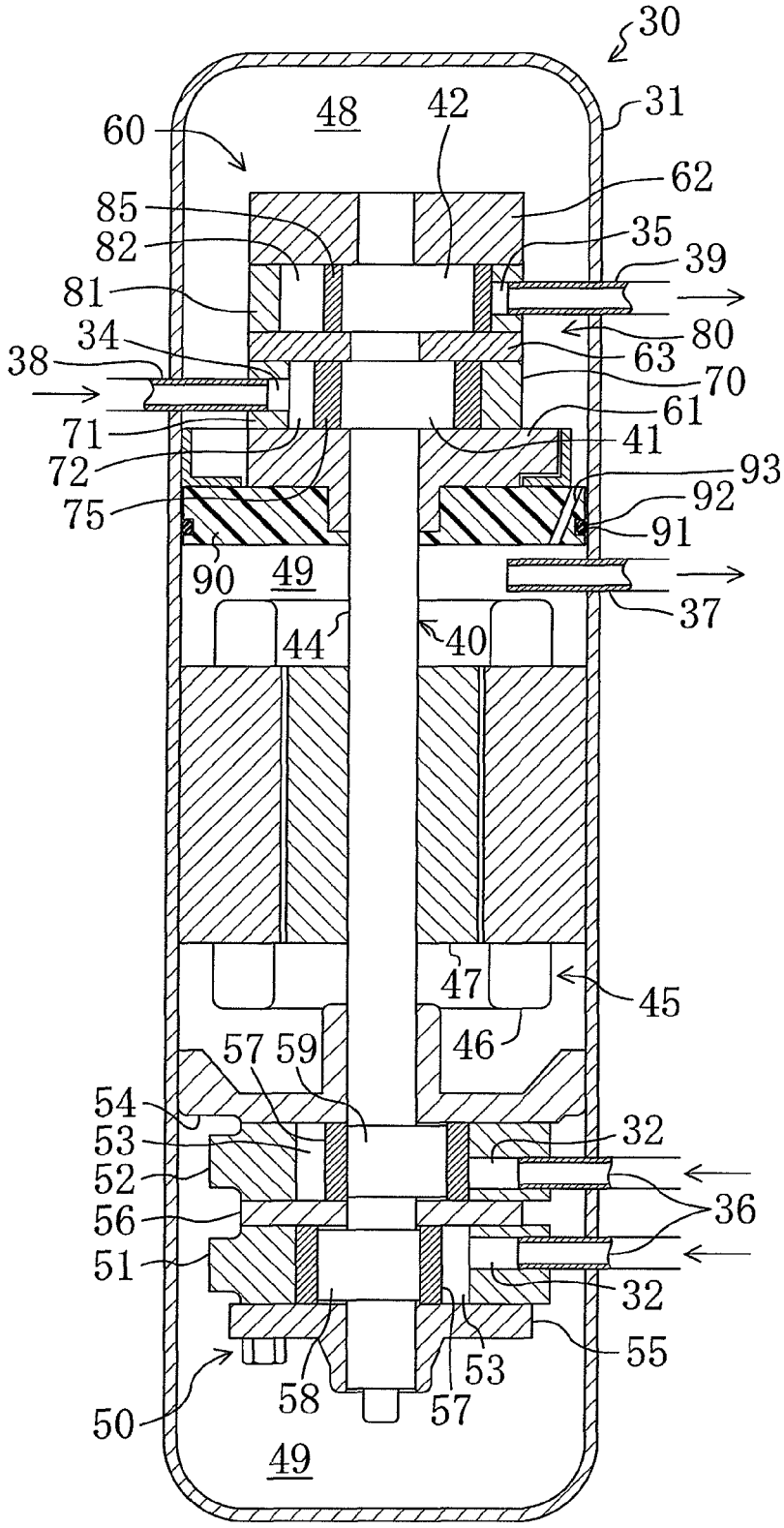
FIG. 2 is a longitudinal cross-sectional view showing a schematic structure of a compression/expansion unit according to Embodiment 1.

As shown in FIG. 2, the compression/expansion unit (30) includes a casing (31) that is a vertically long, cylindrical, closed container. Inside the casing (31), the compression mechanism (50), the electric motor (45) and the expansion mechanism (60) are arranged in bottom to top order. Furthermore, refrigerating machine oil serving as lubricating oil is accumulated at the bottom of the casing (31). In other words, inside the casing (31), refrigerating machine oil is accumulated towards the compression mechanism (50).

The internal space of the casing (31) is partitioned into upper and lower spaces by a later-described heat insulator (90) disposed under a front head (61) of the expansion mechanism (60). The upper space constitutes a first space (48) and the lower space constitutes a second space (49). In the first space (48) the expansion mechanism (60) is disposed, while in the second space (49) the compression mechanism (50) and the electric motor (45) are disposed.

Attached to the casing (31) is the discharge pipe (37). The discharge pipe (37) is disposed between the electric motor (45) and the expansion mechanism (60) and communicated with the second space (49) in the casing (31). Furthermore, the discharge pipe (37) is formed in the shape of a relatively short, straight tube and placed in an approximately horizontal position.

The electric motor (45) is disposed in a longitudinally middle part of the casing (31). The electric motor (45) is composed of a stator (46) and a rotor (47). The stator (46) is fixed to the casing (31), such as by shrink fitting. The rotor (47) is placed inside the stator (46). The rotor (47) is coaxially passed through by a main spindle (44) of a rotary shaft (40).

The rotary shaft (40) constitutes a rotation axis. The rotary shaft (40) includes two lower eccentric parts (58, 59) formed towards its lower end and two large-diameter eccentric parts (41, 42) formed towards its upper end. A lower end part of the rotary shaft (40) having the lower eccentric parts (58, 59) formed thereat is engaged with the compression mechanism (50), while an upper end part thereof having the large-diameter eccentric parts (41, 42) formed thereat is engaged with the expansion mechanism (60).

The two lower eccentric parts (58, 59) are formed with a larger diameter than the main spindle (44), in which the lower of the two constitutes a first lower eccentric part (58) and the upper constitutes a second lower eccentric part (59). The first lower eccentric part (58) and the second lower eccentric part (59) have opposite directions of eccentricity with respect to the axis of the main spindle (44).

The two large-diameter eccentric parts (41, 42) are formed with a larger diameter than the main spindle (44), in which the lower of the two constitutes a first large-diameter eccentric part (41) and the upper constitutes a second large-diameter eccentric part (42). The first large-diameter eccentric part (41) and the second large-diameter eccentric part (42) have the same direction of eccentricity. The second large-diameter eccentric part (42) has a larger outer diameter than the first large-diameter eccentric part (41). Furthermore, in terms of degree of eccentricity with respect to the axis of the main spindle (44), the second large-diameter eccentric part (42) is larger than the first large-diameter eccentric part (41).

Although not shown, the rotary shaft (40) has an oil feeding channel formed therein. The oil feeding channel extends along the rotary shaft (40). Its beginning opens at the lower end of the rotary shaft (40) and its end opens at the upper part of the rotary shaft (40). Through the oil feeding channel, refrigerating machine oil is fed to the compression mechanism (50) and the expansion mechanism (60). However, refrigerating machine oil fed to the expansion mechanism (60) is at a minimum, and refrigerating machine oil having lubricated the expansion mechanism (60) does not flow out into the first space (48) but is discharged through the outlet pipe (39).

The compression mechanism (50) is constituted by a so-called oscillating piston rotary compressor. The compression mechanism (50) includes two cylinders (51, 52) and two pistons (57). In the compression mechanism (50), a rear head (55), the first cylinder (51), a middle plate (56), the second cylinder (52) and a front head (54) are stacked in bottom to top order.

The first and second cylinders (51, 52) contain their respective cylindrical pistons (57) disposed, one in the interior of each cylinder. Although not shown, a plate-shaped blade extends from the side surface of each piston (57) and is supported through a swing bush to the associated cylinder (51, 52). The piston (57) in the first cylinder (51) engages with the first lower eccentric part (58) of the rotary shaft (40). On the other hand, the piston (57) in the second cylinder (52) engages with the second lower eccentric part (59) of the rotary shaft (40). Each of the pistons (57, 57) is in slidable contact at its inner periphery with the outer periphery of the associated lower eccentric part (58, 59) and in slidable contact at its outer periphery with the inner periphery of the associated cylinder (51, 52). Thus, a compression chamber (53) is defined between the outer periphery of each of the pistons (57, 57) and the inner periphery of the associated cylinder (51, 52).

The first and second cylinders (51, 52) have their respective suction ports (32) formed, one in each cylinder. Each suction port (32) radially passes through the associated cylinder (51, 52) and its distal end opens on the inner periphery of the cylinder (51, 52). Furthermore, each suction port (32) is extended to the outside of the casing (31) by the associated suction pipe (36).

The front head (54) and rear head (55) have their respective discharge ports formed, one in each head. The discharge port in the front head (54) brings the compression chamber (53) in the second cylinder (52) into communication with the second space (49). The discharge port in the rear head (55) brings the compression chamber (53) in the first cylinder (51) into communication with the second space (49). Furthermore, each discharge port is provided at its distal end with a discharge valve composed of a lead valve, and configured to be opened and closed by the discharge valve. In FIG. 2, the discharge ports and discharge valves are not given. The gas refrigerant discharged from the compression mechanism (50) into the second space (49) is sent through the discharge pipe (37) out of the compression/expansion unit (30).

Figure 3:
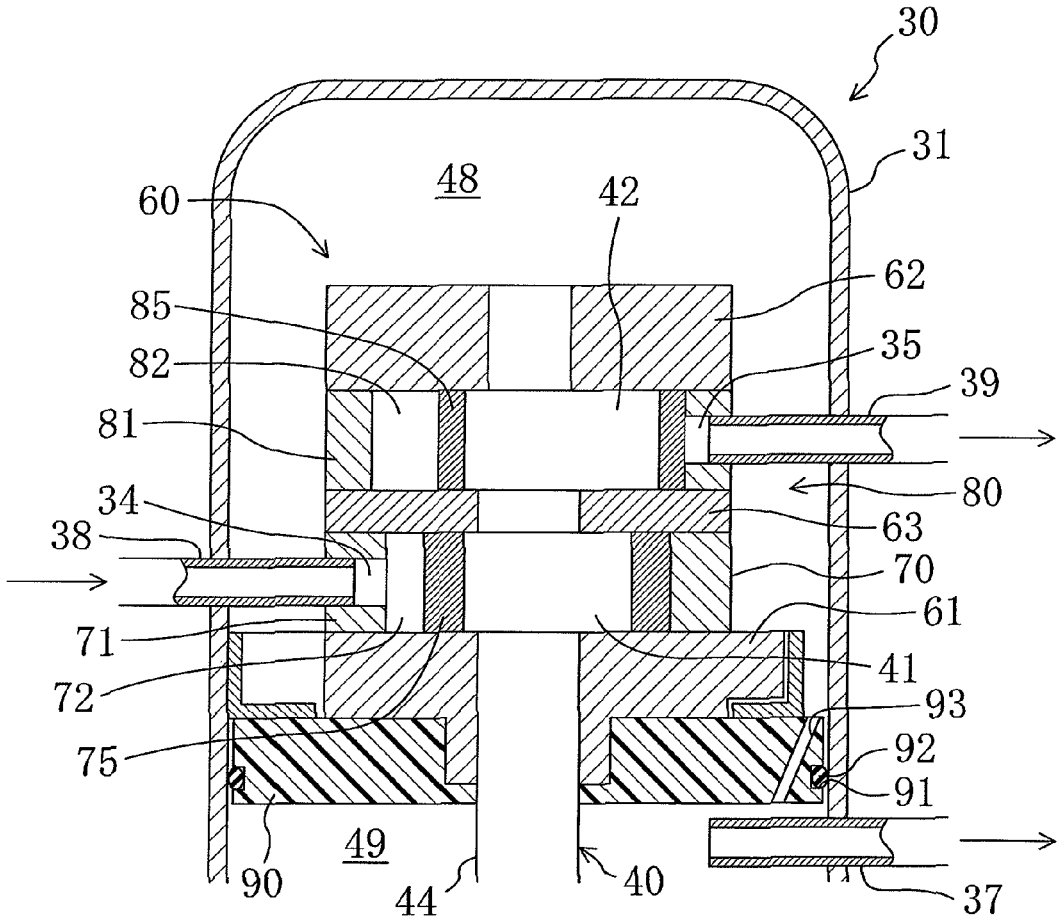
FIG. 3 is a longitudinal cross-sectional view showing an expansion mechanism and a heat insulator in Embodiment 1.

As also shown in magnified form in FIG. 3, the expansion mechanism (60) is constituted by a so-called oscillating piston rotary expander. The expansion mechanism (60) includes two cylinders (71, 72) and two pistons (75, 85) in two cylinder-piston pairs. The expansion mechanism (60) further includes the front head (61), a middle plate (63) and a rear head (62).

In the expansion mechanism (60), the front head (61), the first cylinder (71), the middle plate (63), the second cylinder (81) and the rear head (62) are stacked in bottom to top order. In this state, the first cylinder (71) is closed at the lower end surface by the front head (61) and closed at the upper end surface by the middle plate (63). On the other hand, the second cylinder (81) is closed at the lower end surface by the middle plate (63) and closed at the upper end surface by the rear head (62). Furthermore, the second cylinder (81) has a larger inner diameter than the first cylinder (71).

The rotary shaft (40) passes through the front head (61), the first cylinder (71), the middle plate (63) and the second cylinder (81) that are stacked. The rear head (62) has a center hole formed in the center and passing through the rear head (62) in the thickness direction. Inserted into the center hole of the rear head (62) is the upper end of the rotary shaft (40). Furthermore, the first large-diameter eccentric part (41) of the rotary shaft (40) is located inside the first cylinder (71) and the second large-diameter eccentric part (42) thereof is located inside the second cylinder (81).

Figure 4:
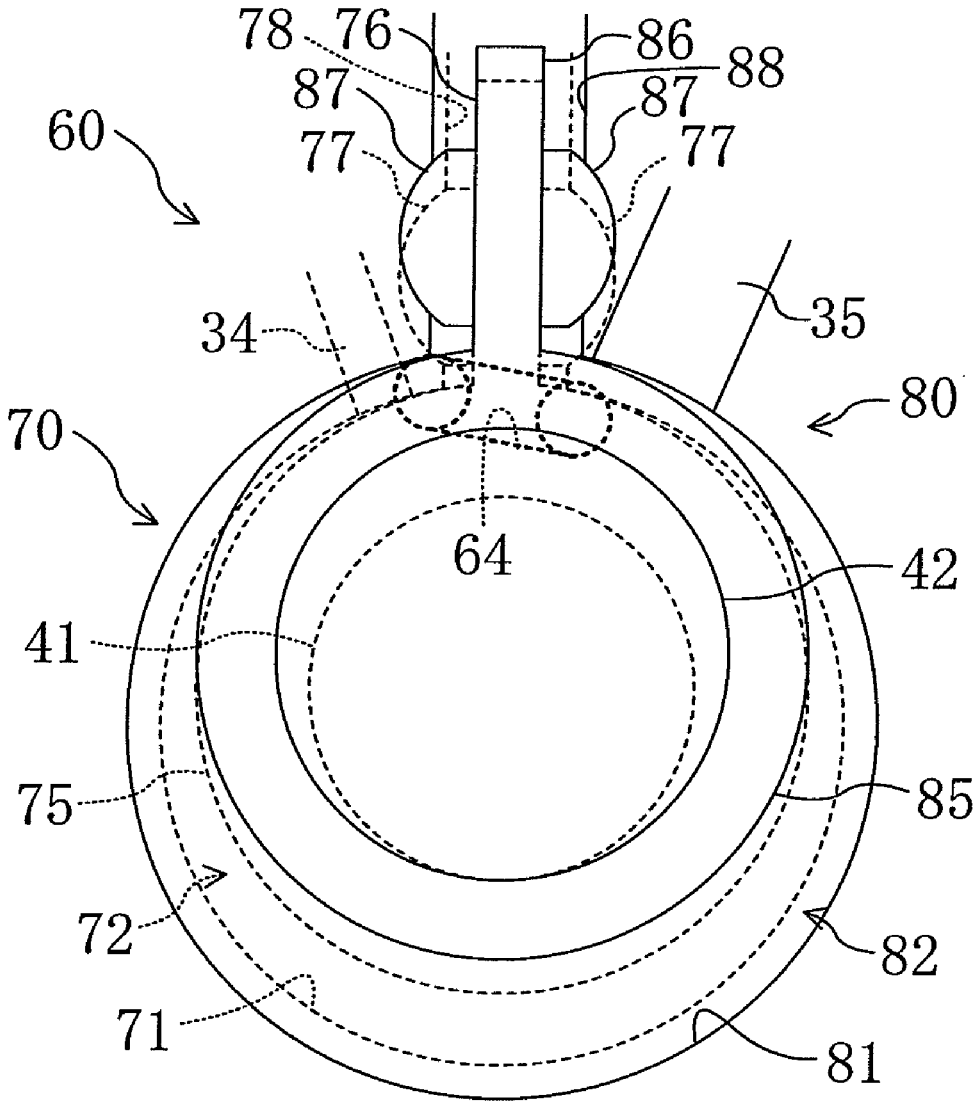
FIG. 4 is an enlarged view showing an essential part of the expansion mechanism in Embodiment 1.
Figure 5:
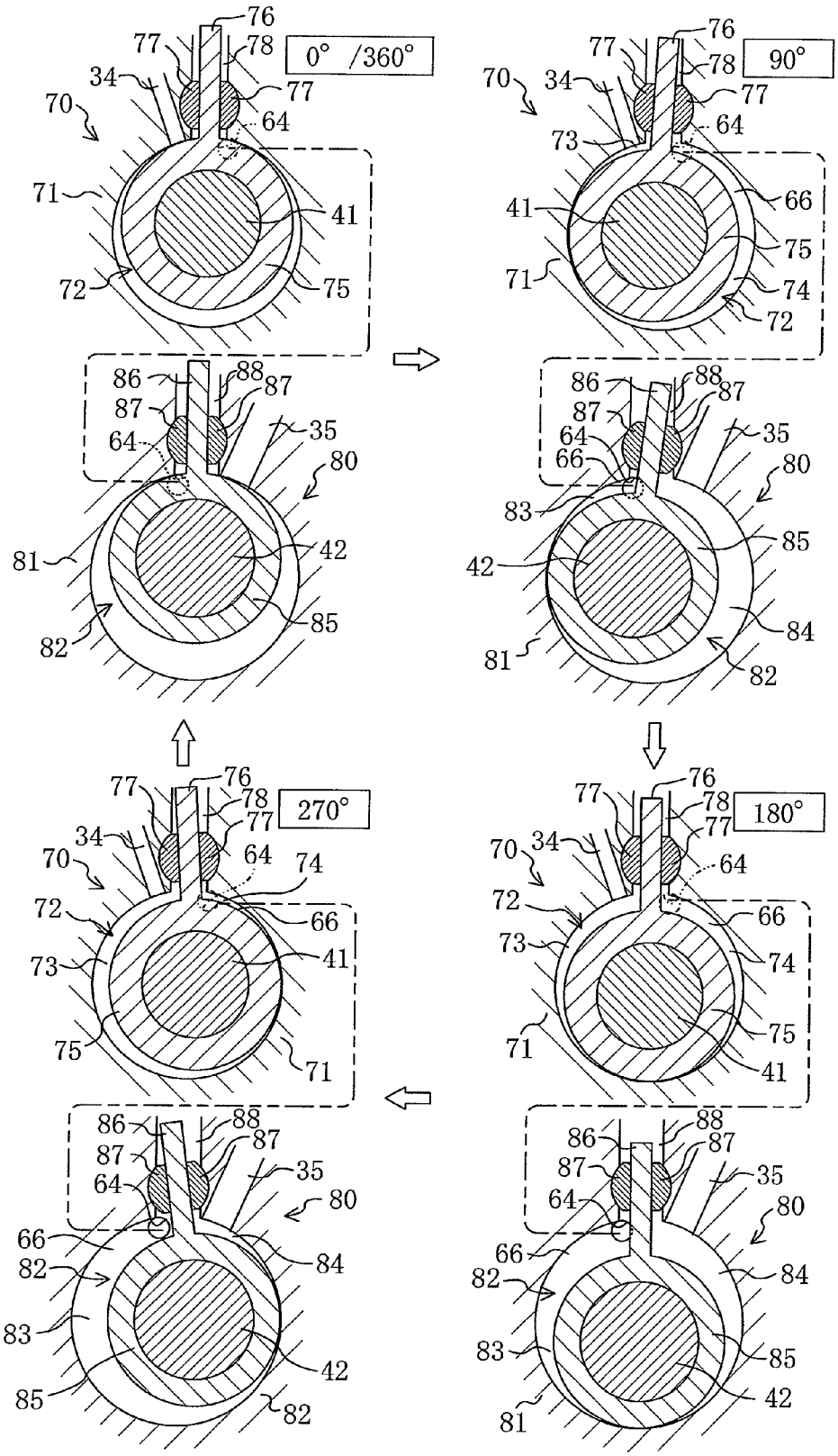
FIG. 5 is schematic transverse cross-sectional views of the expansion mechanism in Embodiment 1, showing the states of the expansion mechanism at every 90° of angle of rotation of a rotary shaft.

As also shown in FIGS. 4 and 5, the first piston (75) and the second piston (85) are placed in the first cylinder (71) and the second cylinder (81), respectively. The first and second pistons (75, 85) are each formed in an annular or cylindrical shape. The outer diameters of the first piston (75) and the second piston (85) are equal to each other. The inner diameter of the first piston (75) is approximately equal to the outer diameter of the first large-diameter eccentric part (41), and the inner diameter of the second piston (85) is approximately equal to the outer diameter of the second large-diameter eccentric part (42). The first piston (75) and the second piston (85) are passed through by the first large-diameter eccentric part (41) and the second large-diameter eccentric part (42), respectively.

The first piston (75) is slidably engaged at the outer periphery with the inner periphery of the first cylinder (71), is in slidable contact at one end surface thereof with the front head (61) and is in slidable contact at the other end surface with the middle plate (63). In the first cylinder (71), its inner periphery defines a first expansion chamber (72) together with the outer periphery of the first piston (75). On the other hand, the second piston (85) is slidably engaged at the outer periphery with the inner periphery of the second cylinder (81), is in slidable contact at one end surface thereof with the rear head (62) and is in slidable contact at the other end surface with the middle plate (63). In the second cylinder (81), its inner periphery defines a second expansion chamber (82) together with the outer periphery of the second piston (85).

The first and second pistons (75, 85) are integrally formed with blades (76, 86), one for each piston. Each blade (76, 86) is formed in the shape of a plate extending in a radial direction of the associated piston (75, 85) and extends outward from the outer periphery of the piston (75, 85). The blade (76) of the first piston (75) and the blade (86) of the second piston (85) are inserted into a bush hole (78) in the first cylinder (71) and a bush hole (88) in the second cylinder (81), respectively. The bush hole (78, 88) of each cylinder (71, 81) passes through the associated cylinder (71, 81) in a thickness direction and opens on the inner periphery of the cylinder (71, 81). These bush holes (78, 88) constitute through holes.

The cylinders (71, 81) are provided with pairs of bushes (77, 87), each cylinder with one pair of bushes. Each bush (77, 87) is a small piece formed so that its inside surface is flat and its outside surface is arcuate. In each cylinder (71, 81), the pair of bushes (77, 87) are inserted into the associated bush hole (78, 88) to sandwich the associated blade (76, 86) therebetween. Each bush (77, 87) slides with the inside surface on the associated blade (76, 86) and slides with the outside surface on the associated cylinder (71, 81). Each blade (76, 86) integral with the piston (75, 85) is supported through the associated bushes (77, 87) to the associated cylinder (71, 81) and is free to angularly move with respect to and free to enter and retract from the cylinder (71, 81).

The first expansion chamber (72) in the first cylinder (71) is partitioned by the first blade (76) integral with the first piston (75); a region thereof to the left of the first blade (76) in FIGS. 4 and 5 provides a first high-pressure chamber (73) of relatively high pressure, while a region thereof to the right of the first blade (76) provides a first low-pressure chamber (74) of relatively low pressure. The second expansion chamber (82) in the second cylinder (81) is partitioned by the second blade (86) integral with the second piston (85); a region thereof to the left of the second blade (86) in FIGS. 4 and 5 provides a second high-pressure chamber (83) of relatively high pressure, while a region thereof to the right of the second blade (86) provides a second low-pressure chamber (84) of relatively low pressure.

The first cylinder (71) and the second cylinder (81) are arranged in postures in which the circumferential relative positions between their associated pairs of bushes (77, 87) coincide with each other. In other words, the angle of displacement of the second cylinder (81) relative to the first cylinder (71) is 0°. As described previously, the first large-diameter eccentric part (41) and the second large-diameter eccentric part (42) have the same direction of eccentricity with respect to the axis of the main spindle (44). Therefore, when the first blade (76) comes to a most retracted position towards the outside of the first cylinder (71), the second blade (86) concurrently comes to a most retracted position towards the outside of the second cylinder (81).

The first cylinder (71) has an inlet port (34) formed therein. The inlet port (34) opens on the inner periphery of the first cylinder (71) slightly to the left of the bushes (77) in FIGS. 4 and 5. The inlet port (34) can be communicated with the first high-pressure chamber (73). On the other hand, the second chamber (81) has an outlet port (35) formed therein. The outlet port (35) opens on the inner periphery of the second cylinder (81) slightly to the right of the bushes (87) in FIGS. 4 and 5. The outlet port (35) can be communicated with the second low-pressure chamber (84).

The middle plate (63) has a communicating channel (64) formed therein. The communicating channel (64) passes through the middle plate (63) in the thickness direction. In the surface of the middle plate (63) facing the first cylinder (71), one end of the communicating channel (64) opens at a position to the right of the first blade (76). In the other surface of the middle plate (63) facing the second cylinder (81), the other end of the communicating channel (64) opens at a position to the left of the second blade (86).

Furthermore, as shown in FIG. 4, the communicating channel (64) extends obliquely with respect to the thickness direction of the middle plate (63) and brings about communication between the first low-pressure chamber (74) and the second high-pressure chamber (83).

In the expansion mechanism (60) in this embodiment configured as described above, a first rotary mechanism (70) is constituted by the first cylinder (71), and the bushes (77), the first piston (75) and the first blade (76) that are provided in association with the first cylinder (71). Furthermore, a second rotary mechanism (80) is constituted by the second cylinder (81), and the bushes (87), the second piston (85) and the second blade (86) that are provided in association with the second cylinder (81).

A feature of the present invention is that the heat insulator (90) is disposed to abut on the side of the expansion mechanism (60) near to the compression mechanism (50) and cover the expansion mechanism (60) from the surroundings of the rotary shaft (40) to the inner periphery of the casing (31). Thus, the heat insulator (90) separates the first space (48), which is located around the low-temperature expansion mechanism (60) and has a significant temperature difference from the atmosphere in the rest of the interior of the casing (31), from the second space (49).

Specifically, the heat insulator (90) is shaped in a disc having a center hole through which the rotary shaft (40) is inserted, and disposed to abut on the under surface of the front head (61) of the expansion mechanism (60). The heat insulator (90) is made of high heat-resistant material, such as super engineering plastics. A minimum clearance is provided between the outer periphery of the rotary shaft (40) and the inner periphery of the heat insulator (90) so as not to interfere with the rotation of the rotary shaft (40).

The heat insulator (90) has an O-ring housing recess (91) formed in the outer periphery thereof. The size of the heat insulator (90) is selected to provide a slight clearance between the outer periphery of the heat insulator (90) and the inner periphery of the casing (31) at room temperatures. The O-ring housing recess (91) houses an O-ring (92) as a seal element or means. The elastically deformable O-ring (92) acts to seal the clearance from the inner periphery of the casing (31).

The heat insulator (90) has a communicating channel (93) formed therein to communicate the first space (48) with the second space (49) and thereby reduce the pressure difference between the first space (48) and the second space (49). In other words, the communicating channel (93) is formed of a through hole passing through the heat insulator (90) from the first space (48) to the second space (49). Thus, the first space (48) and the second space (49) are not hermetically separated from each other but have approximately equal internal pressures.

Operational Actions

Actions of the air conditioner (10) will be described below. Here, a description is given first of the action of the air conditioner (10) in cooling operation, then the action thereof in heating operation and then the action of the expansion mechanism (60).

<Cooling Operation>

In cooling operation, the first four-way selector valve (21) and the second four-way selector valve (22) are switched to the positions shown in the broken lines in FIG. 1. When in this state the electric motor (45) of the compression/expansion unit (30) is energized, refrigerant circulates through the refrigerant circuit (20) so that the refrigerant circuit (20) operates in a vapor compression refrigeration cycle.

The refrigerant compressed by the compression mechanism (50) is discharged through the discharge pipe (37) out of the compression/expansion unit (30). In this state, the refrigerant pressure is higher than the critical pressure. The discharged refrigerant is sent to the outdoor heat exchanger (23) and therein releases heat to the outdoor air. The high-pressure refrigerant having released heat in the outdoor heat exchanger (23) passes through the inlet pipe (38) and then flows into the expansion mechanism (60). In the expansion mechanism (60), the high-pressure refrigerant expands and power is recovered from the high-pressure refrigerant. The low-pressure refrigerant obtained by expansion is sent through the outlet pipe (39) to the indoor heat exchanger (24). In the indoor heat exchanger (24), the refrigerant having flowed therein takes heat from room air to evaporate, thereby cooling the room air. The low-pressure gas refrigerant having flowed out of the indoor heat exchanger (24) passes through the suction pipes (36) and is then sucked through the suction ports (32) into the compression mechanism (50). The compression mechanism (50) compresses the sucked refrigerant and discharges it.

<Heating Operation>

In heating operation, the first four-way selector valve (21) and the second four-way selector valve (22) are switched to the positions shown in the solid lines in FIG. 1. When in this state the electric motor (45) of the compression/expansion unit (30) is energized, refrigerant circulates through the refrigerant circuit (20) so that the refrigerant circuit (20) operates in a vapor compression refrigeration cycle.

The refrigerant compressed by the compression mechanism (50) is discharged through the discharge pipe (37) out of the compression/expansion unit (30). In this state, the refrigerant pressure is higher than the critical pressure. The discharged refrigerant is sent to the indoor heat exchanger (24). In the indoor heat exchanger (24), the refrigerant having flowed therein releases heat to room air, thereby heating the room air. The refrigerant having released heat in the indoor heat exchanger (24) passes through the inlet pipe (38) and then flows into the expansion mechanism (60). In the expansion mechanism (60), the high-pressure refrigerant expands and power is recovered from the high-pressure refrigerant. The low-pressure refrigerant obtained by expansion is sent through the outlet pipe (39) to the outdoor heat exchanger (23) and therein takes heat from the outdoor air to evaporate. The low-pressure gas refrigerant having flowed out of the outdoor heat exchanger (23) passes through the suction pipes (36) and is then sucked through the suction ports (32) into the compression mechanism (50). The compression mechanism (50) compresses the sucked refrigerant and discharges it.

<Action of Expansion Mechanism>

The action of the expansion mechanism (60) is described with reference to FIG. 5.

First, a description is given of the course of flow of supercritical high-pressure refrigerant into the first high-pressure chamber (73) of the first rotary mechanism (70). When the rotary shaft (40) rotates slightly from an angle of rotation of 0°, the contact point between the first piston (75) and the first cylinder (71) passes through the opening of the inlet port (34), so that high-pressure refrigerant begins to flow through the inlet port (34) into the first high-pressure chamber (73). Then, as the angle of rotation of the rotary shaft (40) gradually increases to 90°, 180° and 270°, high-pressure refrigerant flows more into the first high-pressure chamber (73). The flow of the high-pressure refrigerant into the first high-pressure chamber (73) continues until the angle of rotation of the rotary shaft (40) reaches 360°.

Next, a description is given of the course of refrigerant expansion in the expansion mechanism (60). When the rotary shaft (40) rotates slightly from an angle of rotation of 0°, the first low-pressure chamber (74) and the second high-pressure chamber (83) are communicated through the communicating channel (64) with each other, so that the refrigerant begins to flow from the first low-pressure chamber (74) into the second high-pressure chamber (83). Then, as the angle of rotation of the rotary shaft (40) gradually increases to 90°, 180° and 270°, the first low-pressure chamber (74) gradually decreases its volume and, concurrently, the second high-pressure chamber (83) gradually increases its volume, resulting in gradually increasing volume of the expansion chamber (66). The increase in the volume of the expansion chamber (66) continues until just before the angle of rotation of the rotary shaft (40) reaches 360°. The refrigerant in the expansion chamber (66) expands during the increase in the volume of the expansion chamber (66). The expansion of the refrigerant causes the rotary shaft (40) to be driven into rotation. Thus, the refrigerant in the first low-pressure chamber (74) flows through the communicating channel (64) into the second high-pressure chamber (83) while expanding.

Next, a description is given of the course of flow of refrigerant out of the second low-pressure chamber (84) of the second rotary mechanism (80). The second low-pressure chamber (84) starts to be communicated with the outlet port (35) at a point of time when the rotary shaft (40) is at an angle of rotation of 0°. In other words, the refrigerant starts to flow out of the second low-pressure chamber (84) to the outlet port (35). Then, during the period when the angle of rotation of the rotary shaft (40) gradually increases to 90°, 180° and 270° and until it reaches 360°, low-pressure refrigerant obtained by expansion flows out of the second low-pressure chamber (84).

<Action of Heat Insulator>

Since the heat insulator (90) partitions the internal space of the casing (31) into the first space (48) in which the expansion mechanism (60) is placed and the second space (49) in which the compression mechanism (50) is placed, the first space (48) is kept at low temperature and high density and the second space (49) is kept at high temperature and low density.

Meanwhile, considering ease of assembly and prevention of thermal expansion damage to the heat insulator (90) due to a difference in coefficient of linear expansion between the casing (31) and the heat insulator (90), a certain clearance is required between the outer periphery of the heat insulator (90) and the inner periphery of the casing (31).

In this embodiment, since in assembly the elastically deformable O-ring (92) is compressed to deform, the heat insulator (90) can be easily inserted into the casing (31). Furthermore, even if the heat insulator (90) thermally expands, the O-ring (92) is merely compressed and the heat insulator (90) is not damaged. On the other hand, even if the heat insulator (90) thermally contracts, the O-ring (92) put into a compressed state is merely restored and a seal is maintained between the outer periphery of the heat insulator (90) and the inner periphery of the casing (31).

Thus, the interior of the casing (31) is kept under high-temperature and high-pressure conditions. Since the heat insulator (90) isolates the first space (48) located around the low-temperature expansion mechanism (60) and having a significant temperature difference from the atmosphere in the rest of the interior of the casing (31), this effectively prevents occurrence of refrigerant convection.

On the other hand, since high-pressure refrigerant in the second space (49) flows through the communicating channel (93) into the first space (48), the pressure difference between the first space (48) and the second space (49) is reduced. This prevents damage to the heat insulator (90) due to a significant increase in pressure difference between both the spaces.

Effects of Embodiment 1

Hence, the compression/expansion unit of this embodiment can prevent the refrigerant from convecting between the first space (48) around the expansion mechanism (60) and the second space (49) around the compression mechanism (50) to prevent heat exchange due to mass transfer and thereby prevent performance degradation and decrease in power recovery effect, while taking into consideration ease of assembly and prevention of thermal expansion damage to the heat insulator (90) by forming a clearance between the outer periphery of the heat insulator (90) and the inner periphery of the casing (31).

Furthermore, since the first space (48) and the second space (49) are separated from each other by the heat insulator (90) in the close vicinity of the expansion mechanism (60) significantly different in temperature from the atmosphere in the rest of the interior of the casing (31), this effectively prevents occurrence of refrigerant convection to prevent heat exchange due to mass transfer and thereby prevent performance degradation and decrease in power recovery effect.

Moreover, since the clearance between the heat insulator (90) and the inner periphery of the casing (31) is sealed by the O-ring (92), this provides a compression/expansion unit (30) easy to assemble and causing neither performance degradation nor decrease in power recovery effect.

In addition, since the communicating channel (93) is formed in the heat insulator (90) to reduce the pressure difference between the first space (48) and the second space (49), this prevents damage to the heat insulator (90) and thereby increases the durability of the heat insulator (90).

Modification of Embodiment 1

Figure 6:
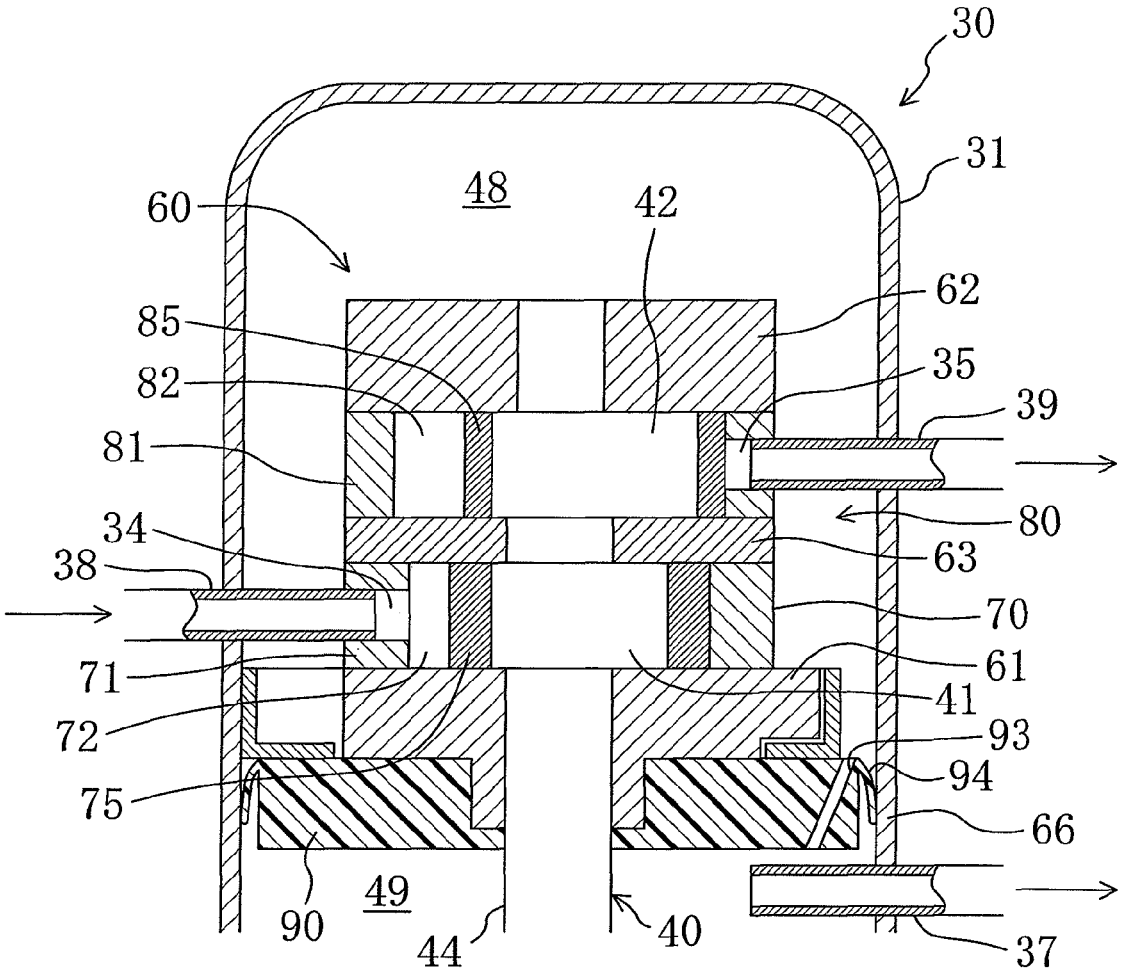
FIG. 6 is a corresponding view of FIG. 3, showing a modification of Embodiment 1.

Although in Embodiment 1 an O-ring (92) is fitted as a seal element (means), around the outer periphery of the heat insulator (90), a flange (94) may be formed instead integrally with the outer periphery of the heat insulator (90) as a seal element (means) as shown in FIG. 6. This can be implemented by integrally molding a thin flange (94) with the heat insulator (90) around the entire circumference of the outer periphery thereof. Thus, since in assembly the elastically deformable flange (94) is compressed to deform, the heat insulator (90) can be easily inserted into the casing (31). Furthermore, even if the heat insulator (90) thermally expands, the flange (94) is merely compressed and the heat insulator (90) is not damaged. On the other hand, even if the heat insulator (90) thermally contracts, the flange (94) put into a compressed state is merely restored and a seal is maintained between the outer periphery of the heat insulator (90) and the inner periphery of the casing (31).

Although in Embodiment 1 the communicating channel (93) is formed in the heat insulator (90), a capillary tube (not shown) may be mounted instead to the outer periphery of the casing (31) to stride over the heat insulator (90) and communicate the first space (48) with the second space (49). Thus, since high-pressure refrigerant in the second space (49) flows through the capillary tube into the first space (48), this prevents damage to the heat insulator (90) due to a significant increase in pressure difference between both the spaces while preventing the refrigerant from convecting. Therefore, the durability of the heat insulator (90) can be increased.

Although in Embodiment 1 the heat insulator (90) is disposed on the expansion mechanism (60) to cover it from the surroundings of the rotary shaft (40) to the inner periphery of the casing (31), it may cover also the outer periphery and top surface of the expansion mechanism (60). Thus, the surface of the expansion mechanism (60) is thermally insulated from the first space (48), which further prevents performance degradation and decrease in power recovery effect.

Embodiment 2

Figure 7:
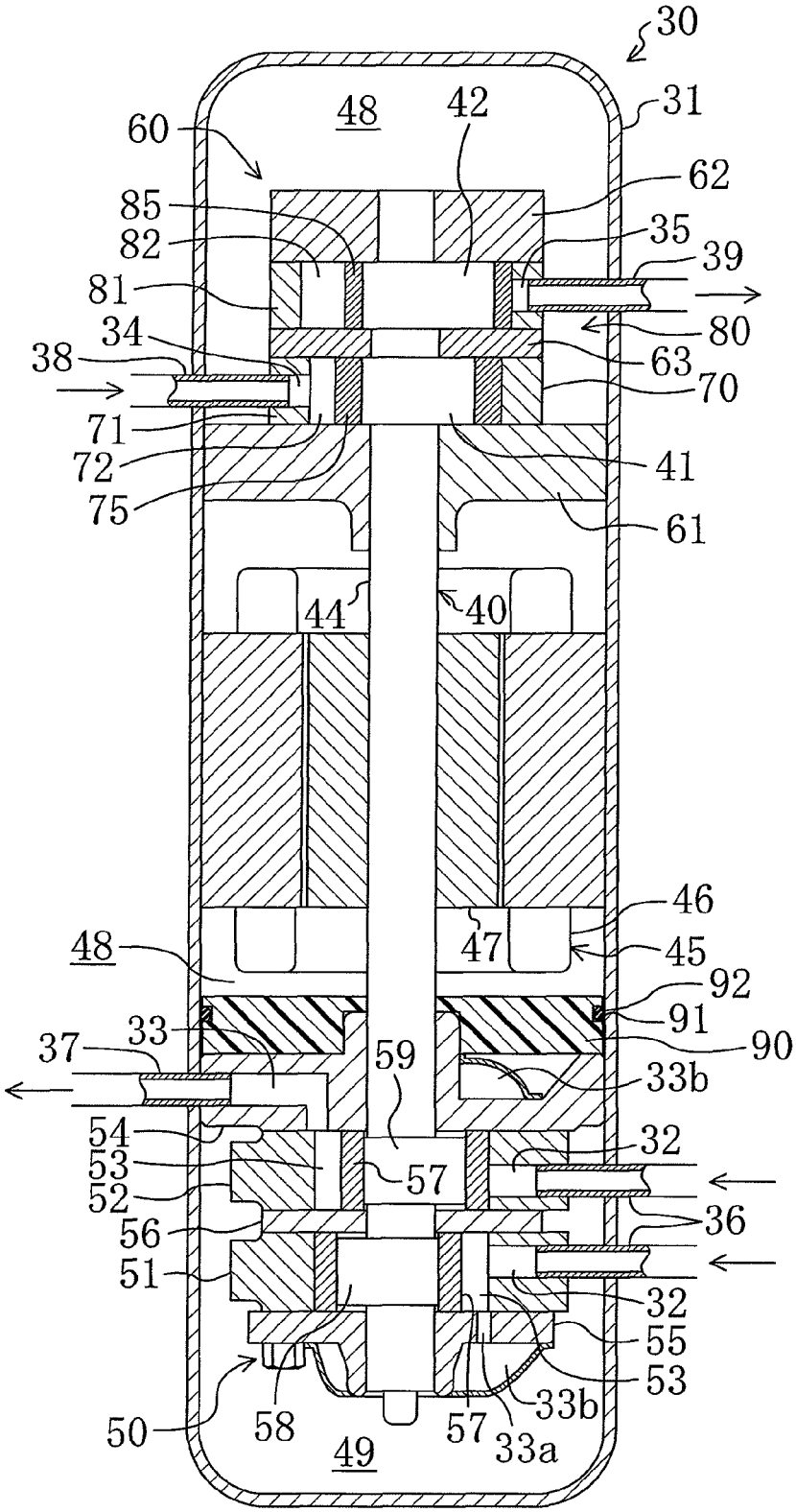
FIG. 7 is a longitudinal cross-sectional view showing a schematic structure of a compression/expansion unit according to Embodiment 2.
Figure 8:
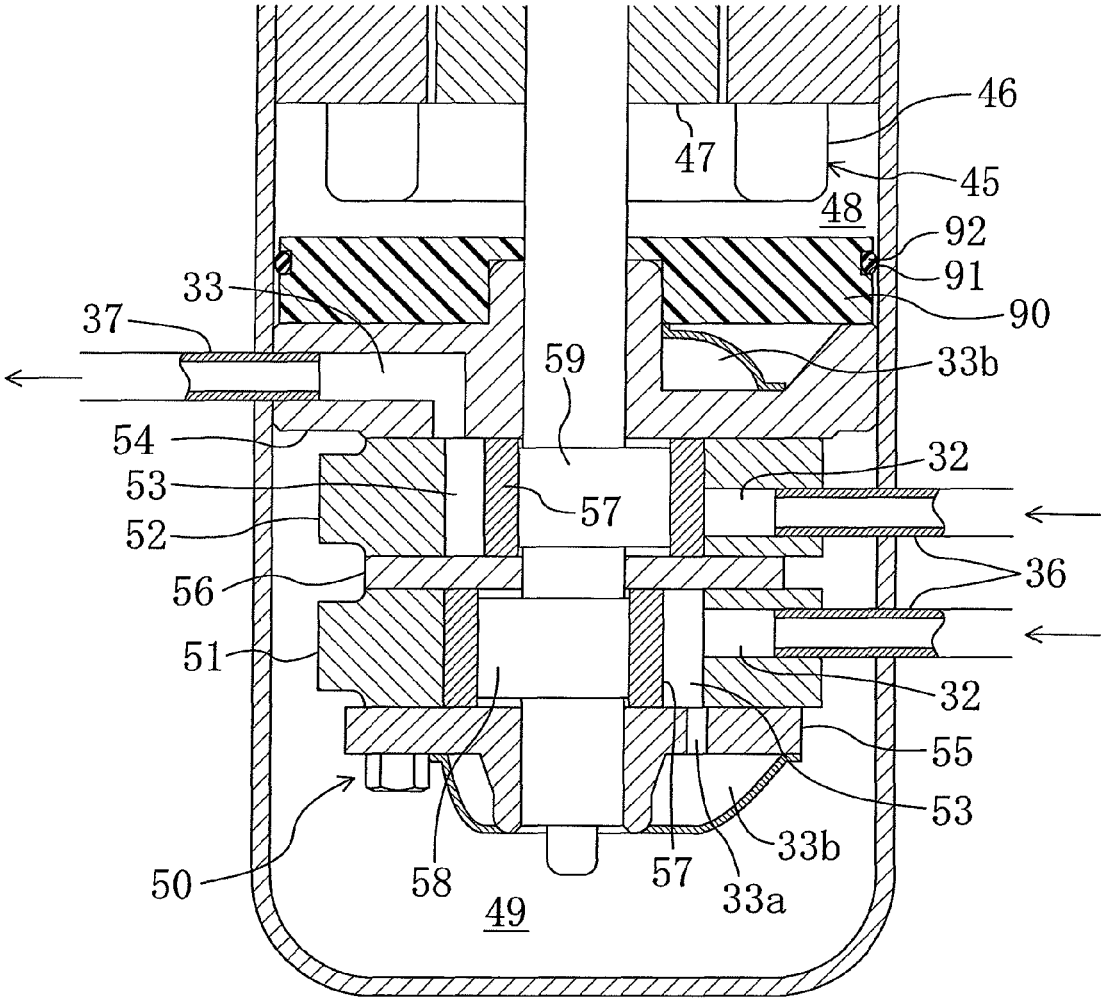
FIG. 8 is a longitudinal cross-sectional view showing an expansion mechanism and a heat insulator in Embodiment 2.

FIG. 7 shows Embodiment 2 of the present invention. This embodiment is different from Embodiment 1 in that the interior of the casing (31) is at low pressure, thereby providing a so-called low-pressure dome compression/expansion unit (30). Note that in this and following embodiments the same parts as in FIGS. 1 to 6 are designated by the same reference numerals and their detailed description is not given.

As shown in FIG. 7, the casing (31) includes, like Embodiment 1, an inlet pipe (38), an outlet pipe (39), suction pipes (36) and a discharge pipe (37). Each suction pipe (36) is connected at one end thereof to a suction port (32) of the compression mechanism (50). The other end of the suction pipe (36) passes through the casing (31) and is then connected to a pipe of the refrigerant circuit (20). In other words, each suction pipe (36) is configured to lead refrigerant of low temperature and low pressure from the outside of the casing (31) into the compression mechanism (50).

Also in this embodiment, refrigerant of low-temperature and low-pressure obtained by evaporation in the indoor heat exchanger (24) or the outdoor heat exchanger (23) is directly sucked through the suction pipes (36) into the compression mechanism (50) without flowing into the internal space of the casing (31). In other words, in this embodiment, the compression/expansion unit (30) is of low-pressure dome type.

Specifically, the front head (54) and the rear head (55) have their respective discharge ports (33, 33*a*) formed, one in each head. The discharge port (33) in the front head (54) is communicated at its beginning with the high-pressure side of the compression chamber (53) in the second cylinder (52). The discharge port (33*a*) in the rear head (55) is communicated at its beginning with the high-pressure side of the compression chamber (53) in the first cylinder (51) and communicated at its distal end with a discharge chamber (33*b*) provided on the outside of the rear head (55). The discharge chamber (33*b*) is communicated with the discharge port (33) in the front head (54). Thus, refrigerant compressed in the compression chamber (53) in the first cylinder (51) flows through the discharge chamber (33*b*) into the discharge port (33) in the front head (54) and then meets refrigerant compressed in the compression chamber (53) in the second cylinder (52). Furthermore, although not shown, each discharge port (33, 33*a*) is provided with a discharge valve composed of a lead valve, and configured to be opened and closed by the discharge valve.

The discharge pipe (37) is connected at one end thereof to the distal end of the discharge port (33) in the front head (54) of the compression mechanism (50). The other end of the discharge pipe (37) passes through the casing (31) and is then connected to a pipe of the refrigerant circuit (20). In other words, the discharge pipe (37) is configured to lead refrigerant compressed in the compression mechanism (50) from the compression mechanism (50) to the outside of the casing (31).

Thus, refrigerant of high temperature and high pressure discharged from the compression mechanism (50) does not flow into the internal space of the casing (31), but the internal space is filled with refrigerant of low temperature and low pressure sucked in through the suction pipes (36). Therefore, the casing (31) is formed in a so-called low-pressure dome. Hence, the expansion mechanism (60) is prevented from being heated by high-temperature discharged refrigerant, while the high-temperature discharged refrigerant is prevented from being cooled by the expansion mechanism (60).

Furthermore, a feature of the present invention is that the internal space of the casing (31) is partitioned into upper and lower spaces by a heat insulator (90) disposed over the front head (54) of the compression mechanism (50) to abut on the front head (54). The upper space constitutes a first space (48) and the lower space constitutes a second space (49). In the first space (48) the expansion mechanism (60) and an electric motor (45) are disposed, while in the second space (49) the compression mechanism (50) is disposed.

Thus, the heat insulator (90) isolates the second space (49) located around the high-temperature compression mechanism (50) and having a significant temperature difference from the atmosphere in the rest of the interior of the casing (31). This effectively prevents occurrence of refrigerant convection to prevent heat exchange due to mass transfer and thereby prevent performance degradation and decrease in power recovery effect.

Effects of Embodiment 2

Hence, according to the compression/expansion unit (30) of this embodiment, since the first space (48) and the second space (49) are separated from each other by the heat insulator (90) in the close vicinity of the high-temperature compression mechanism (50) significantly different in temperature from the atmosphere in the rest of the interior of the casing (31), this effectively prevents occurrence of refrigerant convection to prevent heat exchange due to mass transfer and thereby prevent performance degradation and decrease in power recovery effect.

Modification of Embodiment 2

Like the modification of Embodiment 1, a flange (94) may be formed as a seal means integrally with the outer periphery of the heat insulator (90). Furthermore, a capillary tube may be mounted to the outer periphery of the casing (31) to stride over the heat insulator (90) and communicate the first space (48) with the second space (49).

Although in this embodiment the heat insulator (90) is disposed on the top of the front head (54) of the compression mechanism (50) to cover it from the surroundings of the rotary shaft (40) to the inner periphery of the casing (31), it may cover also the outer periphery and under surface of the compression mechanism (50). Thus, the surface of the compression mechanism (50) is thermally insulated from the second space (49), which further prevents performance degradation and decrease in power recovery effect.

Other Embodiments

Although in the above embodiments the expansion mechanism (60) is constituted by an oscillating piston rotary expander, the expansion mechanism (60) may be constituted by a rolling piston rotary expander. In this expansion mechanism (60), the blade (76, 86) in each of the rotary mechanisms (70, 80) is formed separately from the associated piston (75, 85). Thus, the distal end of the blade (76, 86) is pushed against the outer periphery of the associated piston (75, 85), whereby the blade (76, 86) moves forward and backward with movement of the associated piston (75, 85).

Although in the above embodiments carbon dioxide is used as refrigerant, R410A, R407C or isobutane may be used instead as refrigerant.

Although in the above embodiments the electric motor (45) is disposed above the compression mechanism (50) in the second space (49), it may be disposed below the compression mechanism (50).

The above embodiments are merely preferred embodiments in nature and are not intended to limit the scope, applications and use of the invention.

INDUSTRIAL APPLICABILITY

As can be seen from the above description, the present invention is useful for a fluid machine in which a compression mechanism and an expansion mechanism are contained in a single casing.

What is claimed is:

1. A fluid machine for a refrigerant circuit operating in a refrigeration cycle by circulating a refrigerant therethrough, the fluid machine comprising:

a casing;

a compression mechanism disposed in the casing and configured to compress the refrigerant;

an expansion mechanism disposed in the casing and configured to expand the refrigerant;

a rotary shaft disposed in the casing and connecting the compression mechanism and the expansion mechanism;

a heat insulator disposed in an internal space of the casing with the rotary shaft passing therethrough, the heat insulator partitioning the internal space of the casing into a first space with the expansion mechanism disposed therein and a second space with the compression mechanism disposed therein; and an elastically deformable seal element arranged to seal a clearance between an outer periphery of the heat insulator and an inner periphery of the casing.

2. The fluid machine of claim 1, wherein the fluid machine is configured so that the refrigerant is introduced from the refrigerant circuit directly into the compression mechanism, the refrigerant compressed by the compression mechanism is discharged from the compression mechanism into the second space, and the refrigerant in the second space flows out of the second space to an area outside of the casing; and the heat insulator abuts a side of the expansion mechanism near to the compression mechanism.

3. The fluid machine of claim 1, wherein the fluid machine is configured so that the refrigerant is introduced from the refrigerant circuit directly into the compression mechanism and the refrigerant compressed by the compression mechanism is discharged directly to an area outside of the casing; and the heat insulator abuts a side of the compression mechanism near to the expansion mechanism.

4. The fluid machine of claim 1, wherein the seal element is an O-ring fitted around the outer periphery of the heat insulator.

5. The fluid machine of claim 1, wherein the seal element is a flange integrally formed on the outer periphery of the heat insulator.

6. The fluid machine of claim 1, wherein a communicating channel communicates the first space with the second space to reduce a pressure difference between the first space and the second space.

7. The fluid machine of claim 6, wherein the communicating channel is formed in the heat insulator.

8. The fluid machine of claim 6, wherein the communicating channel is formed by a capillary tube mounted to an outer periphery of the casing to stride over the heat insulator and communicate the first space with the second space.

9. The fluid machine of claim 1, wherein carbon dioxide is used in the refrigerant circuit as the refrigerant to operate in a supercritical refrigeration cycle.

10. The fluid machine of claim 1, wherein the expansion mechanism is a rotary expander including:

a cylinder closed at both ends;

a piston engaged with the rotary shaft and contained in the cylinder to form an expansion chamber; and a blade configured to partition the expansion chamber into a high-pressure chamber and a low-pressure chamber.

* * * * *

UNITED STATES PATENT AND TRADEMARK OFFICE

CERTIFICATE OF CORRECTION

PATENT NO. : 8,156,756 B2
APPLICATION NO. : 12/515055
DATED : April 17, 2012
INVENTOR(S) : Eiji Kumakura et al.

It is certified that error appears in the above-identified patent and that said Letters Patent is hereby corrected as shown below:

On the Title page change the listing of (12) and (75) from

"(12) and (75) Inventors: Eiji Kamakura, Sakai (JP); Katsumi Sakitani, Sakai (JP)"

to

-- (12) and (75) Inventors: Eiji Kumakura, Sakai (JP); Katsumi Sakitani, Sakai (JP) --

Signed and Sealed this
Tenth Day of July, 2012

David J. Kappos

David J. Kappos
*Director of the United States Patent and Trademark Office*